US005678150A

United States Patent [19]

Takahashi et al.

[11] Patent Number: 5,678,150

[45] Date of Patent: Oct. 14, 1997

[54] IMAGE FORMING APPARATUS

[75] Inventors: Masashi Takahashi, Kanagawa-ken; Minoru Yoshida, Tokyo, both of Japan

[73] Assignee: Kabushiki Kaisha Toshiba, Kawasaki, Japan

[21] Appl. No.: 705,598

[22] Filed: Aug. 30, 1996

[30] Foreign Application Priority Data

Oct. 16, 1995 [JP] Japan ..... 7-266544

[51] Int. Cl.[6] ..... G03G 15/01

[52] U.S. Cl. ..... 399/299; 399/310; 399/313; 399/318

[58] Field of Search ..... 399/299, 310, 399/312, 313, 314, 318; 430/124, 126; 355/271–274, 277

[56] References Cited

U.S. PATENT DOCUMENTS 5,172,175 12/1992 Sekino et al. ..... 399/299
5,386,286 1/1995 Kinouchi et al. ..... 399/299
5,469,248 11/1995 Fujiware et al. ..... 399/313 X

FOREIGN PATENT DOCUMENTS 53-096838 8/1978 Japan .
6-110343 4/1994 Japan .

*Primary Examiner*—Matthew S. Smith
*Attorney, Agent, or Firm*—Foley & Lardner

[57] ABSTRACT

An image forming apparatus includes a first image forming unit to form a first developer image on a first image carrier, a second image forming unit to form a second developer image on a second image carrier, a conveyor belt to convey an image transfer medium to the first and the second image carriers in order, a first transferring roller provided in contact with the conveyor belt facing the first image carrier with the conveyor belt put between to transfer the first developer image on the image transfer medium and a second transferring roller provided in contact with the conveyor belt facing the second image carrier with the conveyor belt put between to transfer the second developer image on the image transfer medium on which the first developer image has been transferred. The first transferring roller is energized toward the conveyor belt by a first magnitude energizing force and the second transferring roller is energized toward the conveyor belt by a second energizing force larger than the first magnitude energizing force.

20 Claims, 4 Drawing Sheets

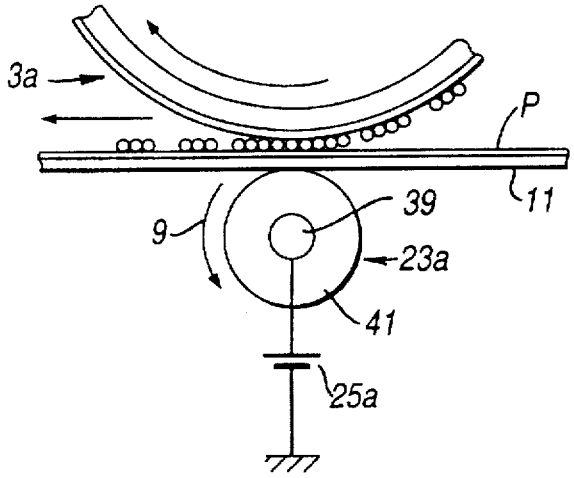
Fig. 2
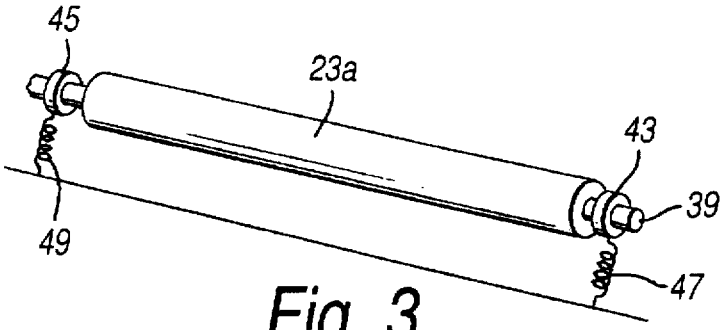
Fig. 3
| | ENERGIZING FORCES OF TRANSFERRING ROLLERS | $D_{tr}$ (mm) | $D_{ph}$ (mm) |
|---|---|---|---|
| TRANSFER REGION Ta | 600g | 1.5 | 2.0 |
| TRANSFER REGION Tb | 800g | 2.1 | 2.3 |
| TRANSFER REGION Tc | 1000g | 2.6 | 2.7 |
| TRANSFER REGION Td | 1200g | 3.0 | 3.0 |
Fig. 4

IMAGE FORMING APPARATUS

BACKGROUND OF THE INVENTION

1. Field of the Invention

The present invention relates to an image forming apparatus that is used in electrophotographic color copying machine, color printer and the like and more particularly to an image forming apparatus to form an image by transferring developer images multiply formed on a plurality of photosensitive drums on such a transfer material as paper.

2. Description of the Related Art

As a conventional image forming apparatus, an image forming apparatus for multiple transferring an image using a semiconductive transfer belt was disclosed in the Japanese Publication of Unexamined Patent Application No. 6-110343. In this patent application, it was disclosed that a semiconductor belt is arranged to convey a sheet of paper to a plurality of photosensitive drums carrying developer images in respective colors in order and transferring rollers are provided on the back of the semiconductor belt at the contacting positions of a paper and respective photosensitive drums. When such a semiconductor belt is used, bias voltage is applied to each transferring roller and a developer image formed on each photosensitive drum is transferred in order on a sheet of paper conveyed on the conveyer belt. This multiple transferred developer images are fixed on the paper by a fixer and thus, a color image is obtained.

The image transfer is achieved by forming a transfer electric field between a photosensitive drum and a transferring roller by applying bias voltage to the transferring roller in each transfer region where a paper and a photosensitive drum is brought in contact with each other. However, there is a slight gap between a paper and the photosensitive drum in the transfer region and a discharge tends to occur in this gap between the transferring drum and a paper. If the discharge is taken place, the surface of a paper on the semiconductive belt is charged in a polarity reverse to that of bias voltage applied to the transferring roller. When performing the multiple transfer, a paper is subject to the repetitive charge by the discharge and electric charge accumulated on the surface of a paper becomes large gradually.

By the way, when a developer image is formed by the reversal development, the charged polarity of the photosensitive drum and the polarity of bias voltage applied to the transferring roller are in the reverse polarity each other. In other words, the polarity of charge accumulated on the surface of a paper by discharge and the charged polarity of the photosensitive drum become the same polarity. Accordingly, there was such a problem that when electric charge was accumulated on the surface of a paper by the multiple transfer on an image forming apparatus which performs the reversal development, repulsive force was produced between a paper on the conveyer belt and the photosensitive drums and it could not bring a paper in contact with the photosensitive drums satisfactorily.

On an image forming apparatus which carries out the multiple transfer using a conventional semiconductive belt as described above, there was such a defect that whenever an image is transferred, the contacting state between a paper and the photosensitive drums becomes worse, reducing the transfer efficiency and deteriorating quality of an obtained image.

SUMMARY OF THE INVENTION

It is an object of the present invention to provide an image forming apparatus capable of carrying out a satisfactory image transfer always by bringing a paper in contact with the photosensitive drums satisfactorily in the image transfer on an image forming apparatus which carries out the multiple image transfer.

According to the present invention, an image forming apparatus comprising first image forming means for forming a first developer image on a first image carrier, second image forming means for forming a second developer image on a second image carrier, conveying means for conveying an image transfer medium to the first and the second image carriers in order, first transferring means provided in contact with the conveying means for transferring the first developer image onto the image transfer medium, second transferring means provided in contact with the conveying means for transferring the second developer image on the image transfer medium on which the first developer image has been transferred, first energizing means for forcing the first transferring means toward the conveying means by a first magnitude force, and second energizing means for forcing the second transferring means toward the conveying means by a second magnitude force larger than the first magnitude force is provided.

BRIEF DESCRIPTION OF THE DRAWINGS

FIG. 2 is a sectional view showing around a transferring means of the image forming apparatus of the present invention;

FIG. 3 is a perspective view showing a transferring means used in the present invention;

FIG. 4 is a table showing energizing forces of transferring rollers provided in respective transfer regions, nip widths of a conveyer belt contacting the conveyer belt and nip widths of the conveyer belt contacting photosensitive drums;

DETAILED DESCRIPTION OF THE PREFERRED EMBODIMENTS

Hereinafter, referring to the attached drawings, a first embodiment of the present invention will be described.

Figure 1:
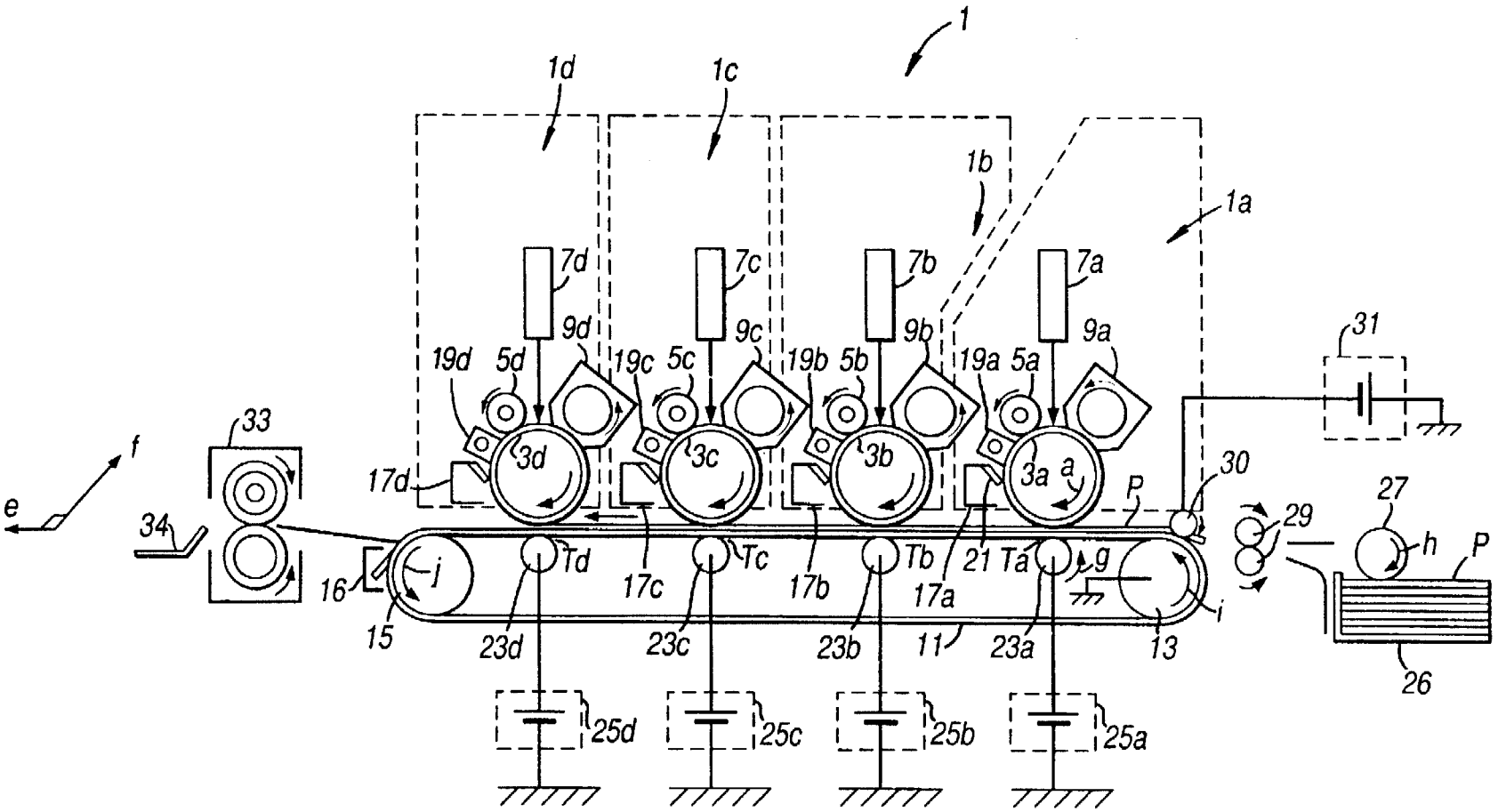
FIG. 1 is a sectional view showing an image forming apparatus involved in a first embodiment of the present invention.

FIG. 1 is a sectional view showing an image forming apparatus 1 involved in a first embodiment of the present invention. In FIG. 1, a process unit 1*a*, a process unit 1*b*, a process unit 1*c* and a process unit 1*d*, which are image forming means, are provided.

Each process unit has a photosensitive drum 3*a*, a photosensitive drum 3*b*, a photosensitive drum 3*c* and a photosensitive drum 3*d*, and a developer image is formed on each of these photosensitive drums.

First, the process unit 1*a* will be explained. In FIG. 1, the photosensitive drum 3*a* is in a cylindrical shape in 40 mm diameter and is provided rotatably in the arrow direction a.

The following items are arranged around the photosensitive drum 3*a* along the direction of rotation. That is, a charging roller 5*a* is first provided in contact with the surface of the photosensitive drum 3*a*. This charging roller 5*a* negative charges the photosensitive drum 3a uniformly. At the downstream (the right center in FIG. 1) of the charging roller 5a, there is an exposure unit 7a provided, which forms an electrostatic latent image by exposing the charged photosensitive drum 3a. Further, at the downstream of the exposure unit 7a there is an developing device 9a which contains a black developer and reversal develops the electrostatic latent image formed by the exposure unit 7a by this black developer. Further, at the downstream of the developing device 9a, there is a conveyor belt 11 as a conveying means to convey a paper P that is an image transfer medium to the photosensitive drum 3a. The conveyor belt 11 conveys the paper P to the photosensitive drum 3a so as to bring the paper P in contact with a developer image formed on the photosensitive drum 3a.

At the downstream of the contacting position of the photosensitive drum 3a and the paper P, a cleaning device 17a and a discharging lamp 19a are provided. The cleaning device 17a has a blade 21 to remove a developer remained on the photosensitive drum 3a after transferring the image by scraping it off. The discharging lamp 19a discharges the electric charge on the surface of the photosensitive drum 3a by applying a light to the surface uniformly. The discharging of this discharging lamp 19a completes one cycle of the image forming and in the next image forming process, the charging roller 5a charges the uncharged photosensitive drum 3a uniformly.

The process unit 1a is comprised of the photosensitive drum 3a, the charging roller 5a, the exposure unit 7a, the developing device 9a, the cleaning device 17a and the discharging lamp 19a described above.

The conveyor belt 11 has a width almost equal to the length of the photosensitive drum 1a in the direction orthogonal to (the arrow direction f in FIG. 1) the conveying direction of paper P (the arrow direction e). This conveyor belt 11 is of endless type and put on a driving roller 13 which rotates the conveyor belt at a specified speed and a driven roller 15. A distance from the driving roller 13 to the driven roller 15 is 300 mm. The driving roller 13 and the driven roller 15 are provided rotatably in the arrow directions i and j, respectively. As the driven roller 15 rotates with the rotation of the driving roller 13, the conveyor belt 11 is rotated. The conveyor belt 11 is formed by a 100 μm thick polyamide with carbon dispersed uniformly. This conveyor belt has electric resistance of $10^9$ Ω.cm and presents semiconductivity.

Above the conveyor belt 11, process units 1b, 1c and 1d are arranged in addition to the process unit 1a along the conveying direction of the paper P between the driving roller 13 and the driven roller 15.

The process units 1b, 1c and 1d are almost all in the same construction as the process unit 1a. That is, photosensitive drums 3b, 3c and 3d are provided almost at the center of respective process units. Around respective photosensitive drums, charging rollers 5b, 5c and 5d are provided. At the downstream of respective charging rollers, exposure units 7b, 7c and 7d are provided. At the downstream of the exposure units, developing devices 9b, 9c and 9d, cleaning devices 17b, 17c and 17d, and discharging lamps 19b, 19c and 19d are provided in the same construction as the process unit 1a. They are different only in developers contained in the developing devices. The developing devices 9b, 9c and 9d contain a yellow, magenta and cyanic developers, respectively.

A paper P conveyed by the conveyor belt 11 is brought in contact with respective photosensitive drums in order. In the vicinity of the contacting position of this paper P with respective photosensitive drums, transferring rollers 23a, 23b, 23c and 23d are provided to respective photosensitive drums as transfer means. That is, the transferring rollers are provided in contact with the back of the conveyor belt 11 at the lower positions of the corresponding photosensitive drums, facing the process units with the conveyor belt 11 put between. These transferring rollers rotate in the arrow direction g following the movement of the conveyor belt 11.

There is a region (called as a transfer region) Ta formed between the photosensitive drum 3a and the transferring roller 23a for transferring a developer image. Similar to the transfer region Ta, transfer regions Tb, Tc and Td are formed between the photosensitive drum 3b and the transferring roller 23b, the photosensitive drum 3c and the transferring roller 23c, and the photosensitive drum 3d and the transferring roller 23d, respectively.

The transferring roller 23a is connected to a direct voltage source 25a as a voltage power supply means. Similarly, the transferring rollers 23b, 23c and 23d are connected to direct voltage sources 25b, 25c and 25d, respectively.

On the other hand, a paper supply cassette 26 is provided at the right front of the conveyor belt 11 in FIG. 1 to contain paper P. In the main body of the image forming apparatus 1, a pick-up roller 27 is provided rotatably in the arrow direction h to pick up paper P one by one from the paper supply cassette 26. There is a register roller pair 29 provided rotatably between the pick-up roller 27 and the conveyor belt 11. The register roller pair 29 supplies the paper P onto the conveyor belt 11 at a specified timing. Further, on the conveyor belt 11 an adsorbing roller 30 to adsorb the paper P electrostatically on the surface of the conveyor belt 11 is arranged to face the driving roller 13 with the conveyor belt 11 put between. This adsorbing roller 30 is connected to a direct negative voltage source 31.

Further, at the left front of the conveyor belt 11 in FIG. 1 there are a fixer 33 to fix an developer image on the paper P and a receiving tray 34 into which the paper P with the developer image fixed by the fixer 33 is ejected.

Now, the image forming process of the image forming apparatus 1 in the construction as described above will be explained. If the start of image forming is directed through an operating panel (not shown), the photosensitive drum 3a receives a driving force from a driving mechanism (not shown) and starts to rotate. The charging roller 5a charges this photosensitive drum 3a uniformly to about −500 V.

The exposure unit 7a forms an electrostatic latent image on the photosensitive drum 3a uniformly charged by the charging roller 5a by applying a light corresponding to an image to be recorded. The developing device 9a develops the electrostatic latent image by a developer that is charged to about −20 μc/g and forms a black developer image.

In the similar manner as in forming a developer image on the photosensitive drum 3a, and developer image in each color is formed on the photosensitive drums 3b, 3c and 3d, respectively.

On the other hand, the pick-up roller 27 takes out paper P from the paper supply cassette 26 and the register roller pair 29 supplies the paper P on the conveyor belt 11. The paper P supplied on the conveyor belt 11 and the adsorbing roller 30 are brought in contact with each other and the adsorbing roller 30 charges negative the surface of the paper P. The charged paper P is electrostatically adsorbed on the conveyor belt 11.

The conveyor belt 11 conveys the electrostatically adsorbed paper P toward the photosensitive drums 3a, 3b, 3c and 3d in order.

When the paper P reaches the transfer region Ta, about 1,000 V bias voltage is applied to the transferring roller 23a. Between the transferring roller 23a and the photosensitive drum 3a, a transfer electric field is formed and the developer image formed on the photosensitive drum 3a is transferred on the paper P according to this transfer electric field.

The paper P with the developer image transferred in the transfer region Ta is conveyed toward the transfer region Tb. In the transfer region Tb, about 1,200 V bias voltage is applied to the transferring roller 25b from the direct voltage source 25b and a yellow developer image is transferred by superposing on the black developer image. After the transfer of the yellow developer image, the paper P is further conveyed toward the transfer regions Tc an Td.

By applying about 1,400 V bias voltage to the transferring roller 23c in the transfer region Tc and about 1,600 V bias voltage to the transferring roller 23d in the transfer region Td, a magenta developer image and a cyanic developer image are transferred multiply by superposing on the already transferred developer images.

The developer images multiple transferred in respective colors are fixed on the paper P by the fixer 33, and a color image is thus formed. The paper P with the fixed color image is ejected on the receiving tray 34.

The portions relative to the image transfer will be further described in detail using FIG. 2 and FIG. 3. The transferring roller 23a is a roller in 20 mm diameter comprising a metallic core member 39 and an elastic layer 41 made of a conductive foamed urethane provided around the core member 39. Electric resistance between the core member 39 and the surface of the elastic layer 41 is about $10^4$ Ω. The core member 39 is connected with the direct voltage source 25a. Hardness of the elastic layer 41 was 45° when measured according to the JIS-A Hardness Measuring Method.

The transferring roller 23a receives a driving force from a motor (not shown) and rotates around the core member 39. The core member 39 is provided with bearings 43 and 45. The bearings 43 and 45 are provided with springs 47 and 49, respectively as an energizing means and by these springs 47 and 49, the transferring roller 23a is energized so that it is brought in contact with the conveyor belt 11 elastically.

As the transferring rollers 23b, 23c and 23d are almost in the same construction as the transferring roller 23a and further, the construction to elastically contact the conveyor belt 11 is also almost the same for all the transferring rollers, the explanation as to the same construction of the transferring rollers 23b, 23c and 23d as the transferring rollers 23a will be omitted.

What is differing in each transferring roller is a magnitude of the energizing force of the springs 47 and 49 provided to each of the transferring rollers. In this embodiment, the energizing force of the transferring rollers 23a, 23b, 23c and 23d are assumed to be 600 g, 800 g, 1000 g and 1200 g, respectively. In other words, in this embodiment the transferring rollers is so constructed that their energizing forces become gradually large. The energizing force referred to here denotes total of an energizing force of the spring 47 and that of the spring 49. The magnitude of energizing force was adjusted by changing the elastic strength of the springs 47 and 49.

The measured results of the contacting width $D_{tr}$ of the transferring roller with the conveyor belt 11 and the contacting width $D_{ph}$ of the photosensitive drum with the conveyor belt 11 when the transferring rollers were energized are shown in FIG. 4. Here, $D_{tr}$ denotes the contacting region between the conveyor belt 11 and each transferring roller along the conveying direction of the paper P, that is, the nip width. Further, $D_{ph}$ denotes the nip width between the conveyor belt 11 and the photosensitive drum along the conveying direction of the paper P. $D_{tr}$ was obtained by measuring the width of the developer region adhered to the transferring rollers by bringing the rollers in contact with the conveyor belt 11 by moving the conveyer belt 11 without driving all the rollers after adhering a developer on the back of the conveyor belt 11. $D_{ph}$ was obtained by measuring the width of the developer region adhered to the conveyor belt 11 by bringing the photosensitive drums in contact with the conveyor belt 11 by rotating the photosensitive drums on the fixed conveyor belt 11 after adhering a developer to each photosensitive drum.

In this embodiment, $D_{ph}$ and $D_{tr}$ in each transfer region becomes large in order of the transfer regions 23a, 23b, 23c and 23d. However, in all the transfer regions, $D_{tr} \leqq D_{ph}$ is satisfied.

Whenever the transfer is carried out by applying voltage to the transfer charger in each transfer region, negative electric charge is accumulated on the surface of the paper P. Therefore, the more the number of transfers increases, the more repulsive force acting between the paper P and the photosensitive drum becomes large.

In this embodiment, as the transfer roller at the downstream that carries out the transfer later is able to bring the paper P in contact with the photosensitive drum with large force against repulsive force between the paper P and the photosensitive drum as it has larger energizing force. Therefore, when the transfer is repeatedly carried out on a sheet of paper, it is possible to make the transfer satisfactorily always by bringing the photosensitive drums in contact with the paper P satisfactorily.

Further, in this embodiment, as hardness of the elastic layer 41 is equal for all transferring rollers and therefore, $D_{tr}$ becomes gradually large in order of the transfer regions 23a, 23b, 23c and 23d as the energizing force of the transferring rollers are gradually increased. When carrying out the multiple transfers, as amount of developers accumulated on a paper P every time the transfer is carried out, it becomes difficult to bring the photosensitive drums in contact with the paper P stably at the transfer regions at the later stage. However, by gradually increasing the energizing force of each transfer roller and also, gradually making $D_{tr}$ large in each transfer region as in this embodiment, it becomes possible to more stably bring the photosensitive drums in contact with the paper P even at the later stages.

Figure 5:
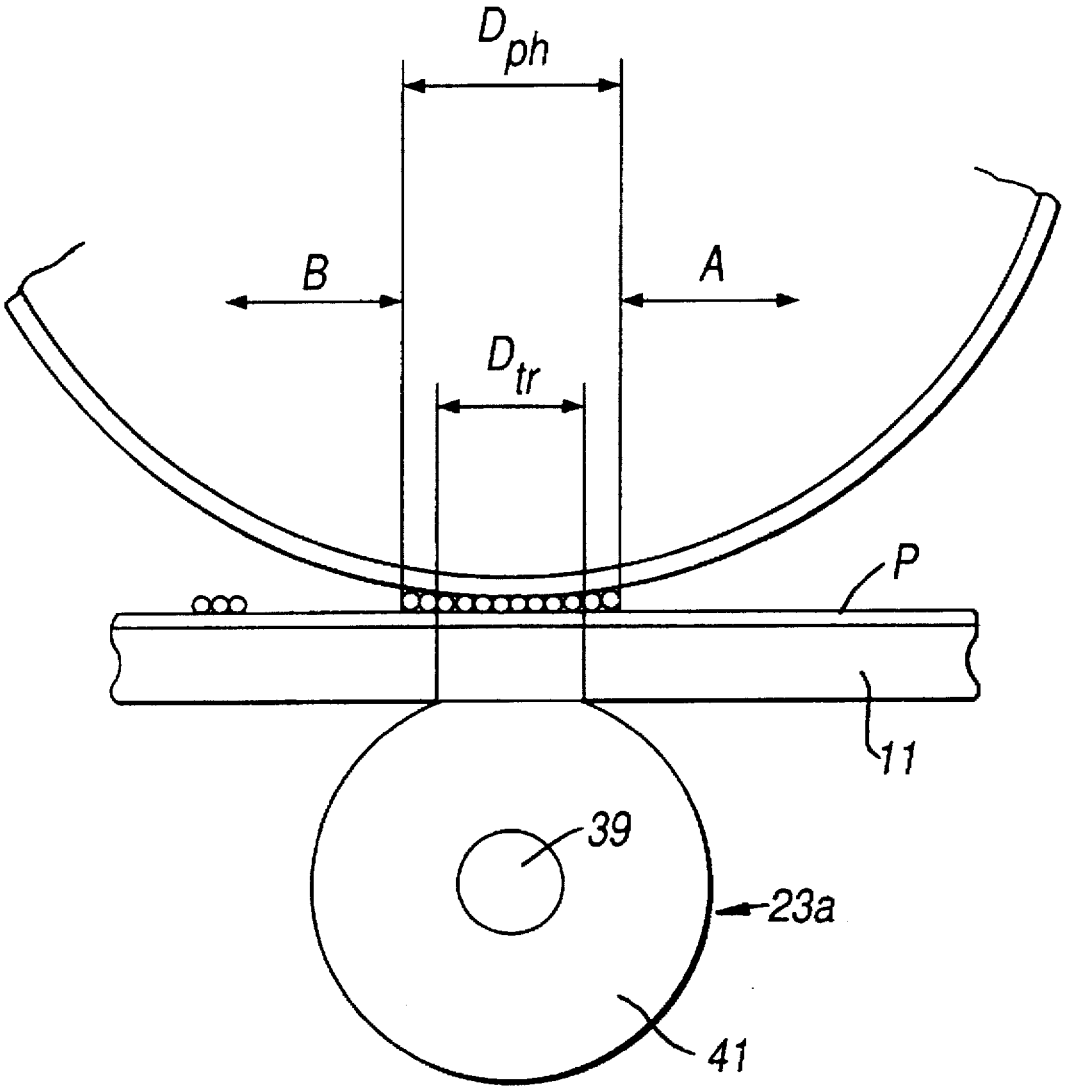
FIG. 5 is a schematic sectional view showing the relation of the nip width $D_{ph}$ with a paper contacting the photosensitive drum and the nip width $D_{tr}$ with the conveyer belt contacting the transferring rollers.

Because of the reason describe above, it is desirable to gradually make $D_{tr}$ large and also to satisfy $D_{tr} \leqq D_{ph}$. If $D_{tr} > D_{ph}$, the transfer electric field acts also on the regions A and B where the paper P is not in contact with the photosensitive drums as shown in FIG. 5. In particular, if the transfer electric field acts on the region A, the developer formed on the photosensitive drum partially scatters. Because of this, that $D_{tr} \leqq D_{ph}$ is desirable.

Further, in this embodiment, the energizing force of each photosensitive roller increases uniformly by 200 g but it is possible to change the energizing force not limited to this. Further, it is better to adjust $D_{tr}$ and $D_{ph}$ by adjusting hardness of the elastic layer 41 of the transferring rollers according to the energizing force of the transferring rollers.

Further, in this embodiment, it is so designed that the bias voltage applied to the transferring rollers is made more larger on the transferring rollers at the downstream. As being thus constructed, it becomes possible to carry out the image transfer in the transfer regions more stably at the downstream.

Actually, when the image transfer was carried on an image forming apparatus in this embodiment, the transfer efficiency in the transfer region Td was as satisfactory as 92%. Further, when the energizing force of all transferring rollers was made 1000 g, the transfer efficiency in the transfer region Td was 80%.

Next, an image forming apparatus in a second embodiment will be explained referring to FIG. 6.

Figure 6:
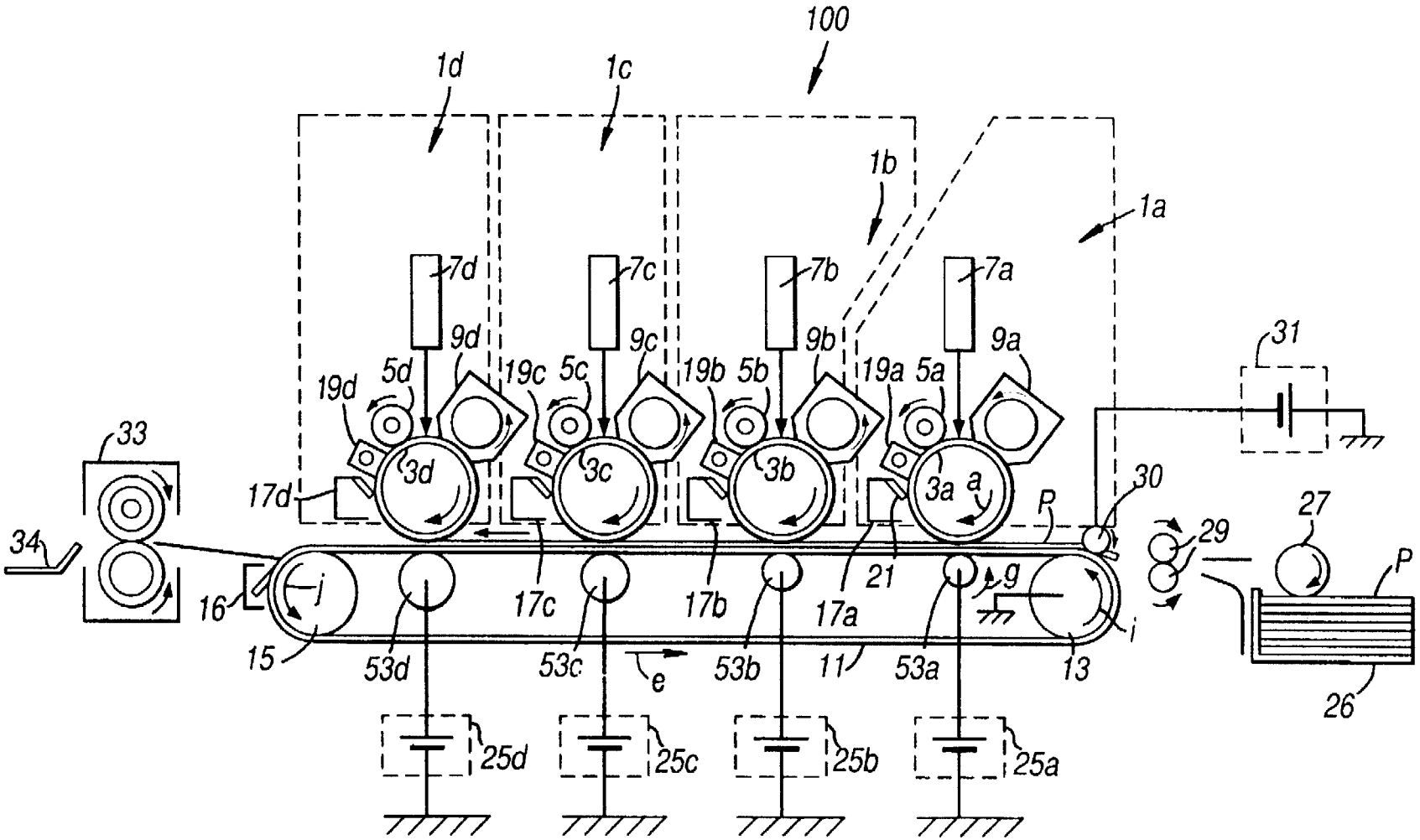
FIG. 6 is a sectional view showing the image forming apparatus involved in a second embodiment of the present invention.

FIG. 6 is a sectional view of an image forming apparatus 100 involved in the second embodiment. As the entire construction of the image forming apparatus 100 is almost the same as the image forming apparatus 1 shown in FIG. 1, the same reference numerals are assigned to the same component parts and the explanation thereof will be omitted.

The image forming apparatus 100 has transferring rollers 53*a*, 53*b*, 53*c* and 53*d* which are in different diameters, respectively. The diameters of the transferring rollers 53*a*, 53*b*, 53*c* and 53*d* are 12 mm, 14 mm, 16 mm and 18 mm, respectively.

These transferring rollers are all forced to contact with the conveyor belt 11 and the energizing forces of the transferring rollers by the springs 47 and 49 are all 1000 g.

In this embodiment, the energizing forces of the transferring rollers are all the same but the diameters of the transferring rollers at the downstream are made more larger. So, the nip width of the photosensitive drums with a paper becomes larger at the photosensitive drums at the downstream and the image transfer can be performed stably even at the downstream. Further, it may be better to combine the first and the second embodiments. That is, the diameters of the transferring rollers may be changed so that they become larger on the rollers at the downstream and also, the energizing force by the springs 47 and 49 is made larger on the rollers at the downstream. When thus constructing the transferring rollers, it becomes possible to more stably bring the transferring rollers in contact with the photosensitive drums at the later stage.

However, even in such a case as above it is desirable that $D_{tr} \leq D_{ph}$ is satisfied.

Although the present invention has been described in several preferred embodiments, it is needless to say that this invention is applicable to various deformed embodiments without departing from its spirit and scope.

For instance, any semiconductive material that has volume resistance $10^9$–$10^{13}$ Ω.cm is usable for the conveyor belt. If a material with volume resistance less than $10^9$ Ω.cm, such a problem may be caused that the electric field formed between the conveyor belt and the photosensitive drums become too large and developers on the photosensitive drums are reverse charged and images may not be transferred satisfactorily. Further, if a material with volume resistance of above $10^{13}$ Ω.cm is used as a conveyor belt, such a problem my be produced that bias voltage is applied to the conveyor belt unnecessarily and the proper electric field is not formed between the photosensitive drums and the conveyor belt and transfer efficiency of developers drops.

Therefore, as a material of the conveyor belt, it is desirable to use a semiconductive material with volume resistance $10^9$–$10^{13}$ Ω.cm.

For instance, polyethyleneterephthalate, polycarbonate, polytetrafluoroethylene, etc. dispersed with such conductive particles as carbon may be usable in addition to polyamide. High molecular film with electric resistance adjusted by adjusting its composition may be used without using conductive particles. Furthermore, high molecular film mixed with ion conductive material or such rubber materials with relatively low electric resistance as silicon rubber, urethane rubber, etc. may be used.

Materials for the transferring rollers are not limited to urethane but various kinds of rubbers such as silicon rubber, etc. are usable.

As described above, according to the present invention, whenever performing the multiple image transfers, it is possible to obtain such an effect that images can be transferred satisfactorily with a paper and the photosensitive drums satisfactorily brought in contact with each other.

What is claimed is:

1. An image forming apparatus comprising:

first image forming means for forming a first developer image on a first image carrier;

second image forming means for forming a second developer image on a second image carrier;

conveying means for conveying an image transfer medium to the first and the second image carriers in order;

first transferring means provided in contact with the conveying means for transferring the first developer image onto the image transfer medium;

second transferring means provided in contact with the conveying means for transferring the second developer image on the image transfer medium on which the first developer image has been transferred;

first energizing means for forcing the first transferring means toward the conveying means by a first magnitude force; and second energizing means for forcing the second transferring means toward the conveying means by a second magnitude force larger than the first magnitude force.

2. An image forming apparatus as claimed in claim 1, wherein the conveying means includes a semiconductive belt having volume resistance $10^9$–$10^{13}$ Ω.cm.

3. An image forming apparatus as claimed in claim 1, wherein the first and the second transferring means include the first and the second transferring rollers, respectively.

4. An image forming apparatus as claimed in claim 3, wherein the first and the second transferring rollers include a metallic core member and a conductive elastic layer provided around the core member, respectively.

5. An image forming apparatus as claimed in claim 3, wherein the first and the second energizing means include springs provided to bring the first and the second transferring rollers in contact with the conveying means elastically, respectively.

6. An image forming apparatus as claimed in claim 3, further comprising a first and a second voltage applying means for applying bias voltage to the first and the second transferring rollers, respectively.

7. An image forming apparatus as claimed in claim 6, wherein bias voltage of the second voltage applying means is larger than the bias voltage of the first voltage applying means.

8. An image forming apparatus comprising:

first image forming means for forming a first developer image on a first image carrier;

second image forming means for forming a second developer image on a second image carrier;

conveying means provided in contact with the first and the second image carriers for conveying an image transfer medium to the first and the second image carriers in order;

first transferring means that has a first size diameter and is provided in contact with the conveying means facing the first image carrier through the conveying means for transferring the first developer image on the image transfer medium; and second transferring means that has a second diameter larger than the first diameter and is provided in contact with the conveying means facing the second image carrier through the conveying means for transferring the second developer image on the image transfer medium on which the first developer image has been transferred.

9. An image forming apparatus as claimed in claim 8, wherein the conveying means includes a semiconductive belt having volume resistance $10^9$–$10^{13}$ Ω.cm.

10. An image forming apparatus as claimed in claim 8, wherein the first and the second transferring means include a first transferring roller in a first diameter and a second transferring roller in a second diameter larger than the first diameter.

11. An image forming apparatus as claimed in claim 10, wherein the first and the second transferring rollers include a metallic core member and a conductive elastic layer provided around the core member, respectively.

12. An image forming apparatus as claimed in claim 10, further comprising a first and a second voltage applying means to apply bias voltage to the first and the second transferring rollers, respectively.

13. An image forming apparatus as claimed in claim 12, wherein bias voltage of the second voltage applying means is larger than bias voltage of the first voltage applying means.

14. An image forming apparatus comprising:

first image forming means for forming a first developer image on a first image carrier;

second image forming means for forming a second developer image on a second image carrier;

conveying means for conveying an image transfer medium to the first and the second image carriers in order;

first transferring means that has a first size diameter and is provided in contact with the conveying means facing the first image carrier through the conveying means for transferring the first developer image on the image transfer medium;

second transferring means that has a second size diameter larger than the first size diameter and is provided in contact with the conveying means facing the second image carrier through the conveying means for transferring the second developer image on the image transfer medium on which the first developer image has been transferred;

first energizing means for forcing the first transferring means toward the conveying means by a first magnitude force; and second energizing means for forcing the second transferring means toward the conveying means by a second magnitude force larger than the first magnitude force.

15. An image forming apparatus as claimed in claim 14, wherein the conveying means includes a semiconductive belt having volume resistance $10^9$–$10^{13}$ Ω.cm.

16. An image forming apparatus as claimed in claim 14, wherein the first and the second transferring means include a first transferring roller in a first diameter and a second transferring roller in diameter larger than the first diameter, respectively.

17. An image forming apparatus as claimed in claim 16, wherein the first and the second transferring rollers include a metallic core member and a conductive elastic layer provided around the core member, respectively.

18. An image forming apparatus as claimed in claim 16, wherein the first and the second energizing means include springs provided to bring the first and the second transferring rollers in contact with the conveying means elastically, respectively.

19. An image forming apparatus as claimed in claim 16, further comprising a first and a second voltage applying means to apply bias voltage to the first and the second transferring rollers, respectively.

20. An image forming apparatus as claimed in claim 19, wherein bias voltage of the second voltage applying means is larger than bias voltage of the first voltage applying means.

* * * * *